US007875216B2

(12) United States Patent
Engelvin et al.

(10) Patent No.: US 7,875,216 B2
(45) Date of Patent: Jan. 25, 2011

(54) POWDER DISPENSER, NOTABLY FOR PELLETIZER AND METHOD FOR MAKING NUCLEAR FUEL PELLETS

(75) Inventors: Pascal Engelvin, Versailles (FR); Jean-Pierre Pages, Sernhac (FR); Jean-Luc Pandraud, Cavillargues (FR); Remy Lavoine, Lussan (FR)

(73) Assignee: Areva NC, Paris (FR)

( * ) Notice: Subject to any disclaimer, the term of this patent is extended or adjusted under 35 U.S.C. 154(b) by 243 days.

(21) Appl. No.: 12/083,867

(22) PCT Filed: Oct. 17, 2006

(86) PCT No.: PCT/EP2006/067499

§ 371 (c)(1),
(2), (4) Date: Apr. 18, 2008

(87) PCT Pub. No.: WO2007/045651

PCT Pub. Date: Apr. 26, 2007

(65) Prior Publication Data

US 2009/0256271 A1 Oct. 15, 2009

(30) Foreign Application Priority Data

Oct. 19, 2005 (FR) ..... 05 53175

(51) Int. Cl.
*G21C 21/00* (2006.01)

(52) U.S. Cl. ..... 264/0.5; 425/352; 425/425

(58) Field of Classification Search ..... 425/352, 425/425, 432, 447; 264/0.5
See application file for complete search history.

(56) References Cited

U.S. PATENT DOCUMENTS 5,352,112 A 10/1994 Moore
2005/0056339 A1 * 3/2005 Beane ..... 141/72

FOREIGN PATENT DOCUMENTS

EP 1052086 A2 11/2000
GB 913387 12/1960
GB 1474328 5/1977
WO 2007045624 A1 4/2007

OTHER PUBLICATIONS

French Preliminary Search Report, FA 670759, FR 0553175, dated Oct. 3, 2006.

* cited by examiner

*Primary Examiner*—Joseph S Del Sole
*Assistant Examiner*—James Sanders
(74) *Attorney, Agent, or Firm*—Nixon Peabody LLP

(57) ABSTRACT

The object of the present invention is mainly a powder dispenser including a casing capable of impulsing the powder in a reciprocal movement on a plane along a determined displacement direction (X), and means (19,23) for grouping the powder along distinct axes, substantially parallel to the X direction. The object of the present invention is also a method for making pellets, notably nuclear fuel pellets, applying a dispenser according to the present invention.

28 Claims, 5 Drawing Sheets

POWDER DISPENSER, NOTABLY FOR PELLETIZER AND METHOD FOR MAKING NUCLEAR FUEL PELLETS

CROSS REFERENCE TO RELATED APPLICATIONS or PRIORITY CLAIM

This application is a national phase of International Application No. PCT/EP2006/067499 entitled "POWDER DISPENSER, NOTABLY FOR PELLETIZER AND METHOD FOR MAKING NUCLEAR FUEL PELLETS", which was filed on Oct. 17, 2006, and which claims priority of French Patent Application No. 05 53175, filed Oct. 19, 2005.

TECHNICAL FIELD AND PRIOR ART

The present invention relates to a powder dispenser, notably used for feeding a device for making pellets of nuclear fuel, for example of the MOX (mixture of plutonium oxide and uranium oxide) type, and a method for making said pellets using such a dispenser.

The making of nuclear fuel pellets includes the following steps:

filling a mould or die having the shape of a pellet, by means of a dispenser, displacing the dispenser in order to release the thereby filled mould, and then pressing via first and second punches which penetrate the mould, evacuating the pellets.

The longest step in this making method is the one for filling the die. Thus, when it is sought to reduce the cycle time for making pellets, it is sought to reduce the time required for filling the die.

A casing is known as a powder dispenser or shoe, including four side walls and an upper wall to which a pipe feeding powder is connected, said casing being suitable to move on a table in which orifices are provided which form a mould for pressing the pellets.

However, the use of MOX powder poses a particular problem because of the fineness of the MOX particles. Indeed, MOX powder has poor flow behaviour, i.e. a poor capacity for continuous flow. The particles then tend to form clusters and to form bridges of powder which block the flow of the powder and therefore its distribution in the dies.

A non-homogeneous distribution of the powder then occurs in the die. The consequence of this is that pellets are made which do not have the sought mass and/or have too dispersed densities.

The characteristics of the pellets should be controlled so as to ensure maximum operating safety when assemblies of nuclear fuel including said pellets are used in nuclear reactors.

Additionally, adhesion of the powder to the walls of the shoe causes a lengthening of the cycle time.

Accordingly, an object of the present invention is to provide a powder dispenser which ensures that pellets are made with homogeneous characteristics.

An object of the present invention is also to provide a dispenser with which the cycle time for making nuclear fuel pellets may be reduced.

DISCLOSURE OF THE INVENTION

The aforementioned objects are achieved by a powder dispenser, suitable to move on a die, including a casing into which powder is fed; inside the casing, surfaces are provided, tilted relative to the direction of displacement of the shoe for grouping the powder along preferential axes.

In other words, the dispenser according to the present invention includes an increased displacement surface as compared with the earlier dispensers, in order to increase impulses applied to the powder.

The subject-matter of the present invention is mainly a powder dispenser including a casing which includes on an upper wall, means for connecting to at least one powder feed pipe connected to a hopper, said dispenser being suitable to impart to the powder a reciprocal movement on a plane along a determined displacement direction, and means for grouping the powder along distinct axes substantially parallel to the displacement direction, in order to fill the dies for pressing pellets, each die being positioned on a distinct grouping axis, the grouping means being borne by walls of the casing perpendicular to the displacement direction and having a saw-tooth section along a plane parallel to the displacement plane.

In an advantageous example, the dispenser includes downstream grouping means and upstream grouping means according to the direction of displacement.

The downstream grouping means are advantageously shifted transversely relative to the upstream grouping means by a tooth half-width, so that a tooth tip is facing a bottom part between two consecutive teeth.

The dispenser according to the present invention advantageously includes longitudinal guide means suitable to cooperate with guide means borne by the displacement plane.

These means for guiding the dispenser and those of the plane may form a slide, the guide means may then include an axial protrusion on each transverse side of the casing, capable of sliding in an axial groove fixed relative to the plane.

Advantageously, the axial protrusion is oriented towards the casing and at least one of the protrusions is removable.

According to the present invention, the dispenser is advantageously connected to displacement means for causing reciprocal movement along the displacement direction via two rotationally fixed arms through a first end on each of the side faces of the casing respectively, and rotationally mobile through a second end opposite to the first end, said arms each including a cylinder.

In an exemplary embodiment, the grouping means are respectively borne by a mobile plate relative to the casing.

Advantageously, the dispenser includes means capable of causing said plates to vibrate relative to the dies along the displacement direction. These excitation means may for example include a vibrator or be of the piezoelectric type.

These vibration means may include a shaft firmly attached through one end to a plate and through a second end to a means for actuating a reciprocal movement along the displacement direction, and suspension means.

The suspension means may for example include a spring pressed between the shaft and the casing.

The dispenser may further include a sealing means interposed between the plates and the wall of the casing facing each other, for example an elastomeric ring with an axis substantially coinciding with that of the arm.

The suspension means may also be an elastomeric ring interposed between the plate and the wall of the casing facing each other, and also form the sealing means.

The elastomeric ring may be adhesively bonded onto the casing and the plate, or firmly attached to the casing and to the plate by vulcanization. The ring may also be force-fitted on a first protruding ring of the casing and on a second protruding ring of the plate.

In a particular example, the ring is maintained between two metal sheet plates so as to form a sandwich plate.

The metal sheets may include windows facing the passage of the ring and in which the window of the metal sheet on the casing side is smaller than the one on the plate side.

For example, the metal sheet in contact with the plate is welded and/or riveted on the latter and includes ends folded back at right angles.

The dispenser advantageously includes a face forming a pusher having the shape of a nose, sliding on the slide plane intended to push the pellets after their formation.

The object of the present invention is also a device for making pellets including a table comprising dies, upper and lower punches intended to press the powder in the dies, a dispenser according to the present invention, means for controlling the displacement of the dispenser according to a reciprocal movement along the first displacement direction, means for conveying the powder into the dispenser, the dies being positioned at least along one row, the distance separating the dies being equal to the distance separating the bottom parts of the teeth, the dispenser being positioned on the dies so that, during a displacement, each bottom part between two teeth covers a die.

The row is advantageously perpendicular to the direction of displacement.

Advantageously, the device includes two rows of parallel dies, the dies of each row being equidistant from each other and the dies of the first row being shifted relative to the dies of the second row by half of the distance separating the dies of the second row.

For example, each row includes seven dies.

The conveying means include at least one feed pipe connecting a hopper to the dispenser.

The feed pipe may extend in the direction of the rows of dies.

The device according to the present invention may include a means for collecting the content of the dispenser after a die filling cycle.

This collecting means may also include at least one orifice provided in the table connected through a pipe to suction means, the orifice being under the dispenser when the latter is in a particular emptying position.

Further, this device may advantageously include means for putting the powder collected by the collecting means in the hopper.

Advantageously, the table can move along an axis perpendicular to its planar face.

The device also includes rails into which the axial protrusions of the dispenser penetrate according to a particular example.

The subject-matter of the present invention is also a method for making pellets including the following steps:

filling dies with powder by means of a powder dispenser provided with grouping means along distinct axial directions corresponding to the positioning of the dies, pressing the powder in the dies, evacuating the pellets.

In a particular example, the shoe may have a reciprocal movement according to a sinusoidal law during the filling step.

In another particular example, the shoe has a reciprocal movement according to a triangular law during the filling step.

Further, the grouping means may be set into vibration.

Additionally, evacuation of the pellets is advantageously carried out by lowering the die and by having the pellets pushed by the dispenser.

The method may also include an additional step for emptying the dispenser.

BRIEF DESCRIPTION OF THE DRAWINGS

The present invention will be better understood with the help of the description which follows and of the appended drawings wherein.

DETAILED DESCRIPTION OF PARTICULAR EMBODIMENTS

Figure 1:
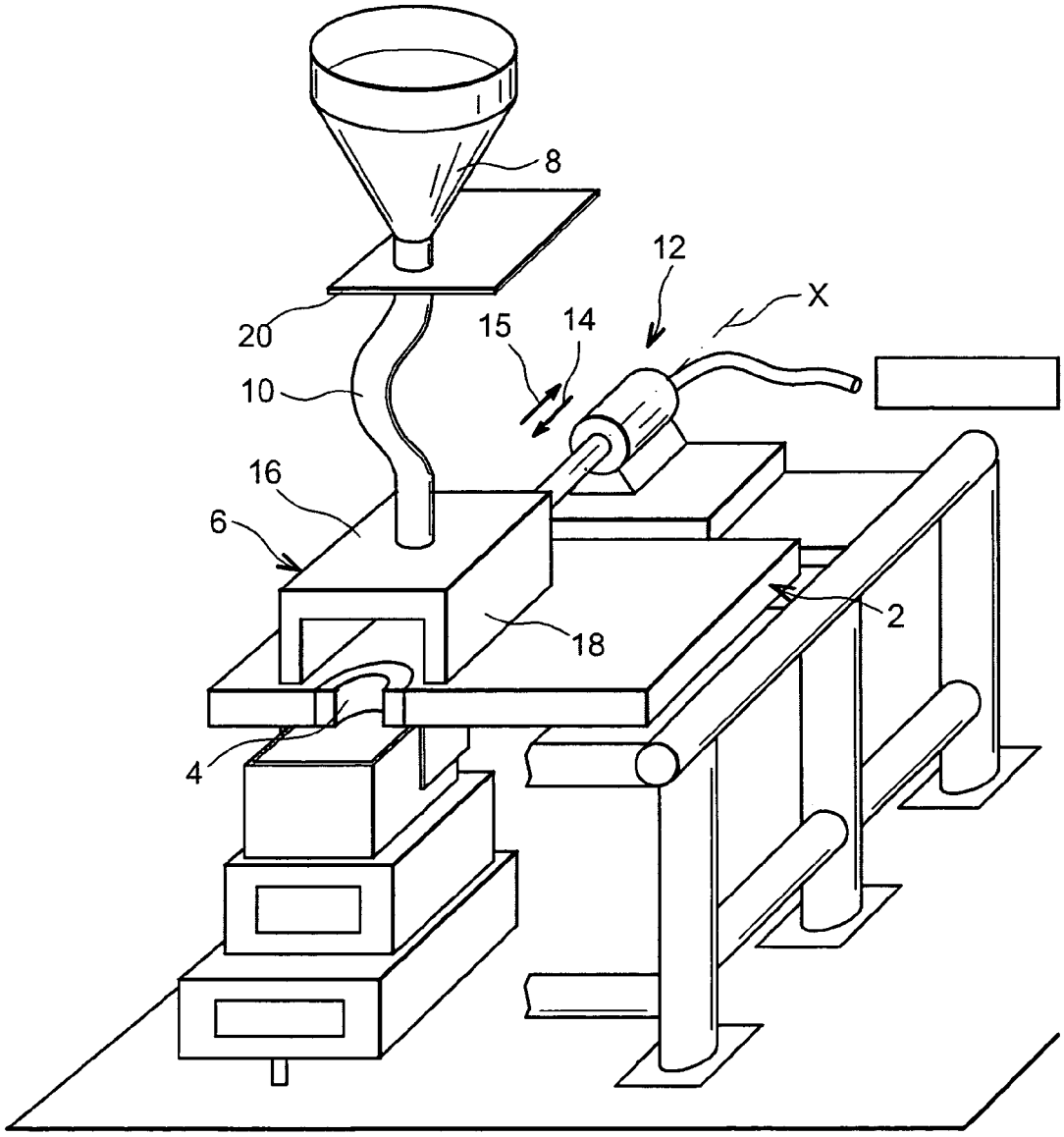
FIG. 1 is a schematic illustration of a device for making nuclear fuel pellets.

In FIG. 1, a device may be seen for making pellets including a table 2, provided with at least one die 4 provided with an orifice in which the powder to be pressed will be positioned, a shoe or powder distributor 6 intended to move above the die 4, a feed hopper 8 connected to the shoe via a pipe 10 and a means 12 for displacing the shoe 6 along an X axis, this means 12 advantageously applying a reciprocal movement according to the arrows 14 and 15.

The shoe 6 is formed by a casing including an upper wall 16 and side walls 18, the pipe 10 being connected to the upper surface 16.

The device also includes a valve 20 interposed between the hopper and the feed pipe 10 so as to control the supply of the shoe with powder.

When the valve 20 is open, the powder contained in the hopper 8 flows into the pipe 10 so as to reach the shoe 6. The shoe 6, under the action of the displacement means 12, will have a longitudinal reciprocal movement along the X axis according to the arrows 14 and 15 and will dispense the powder in the die 4. In the illustrated example, a single die is visible, but several dies may be provided.

Figure 2:
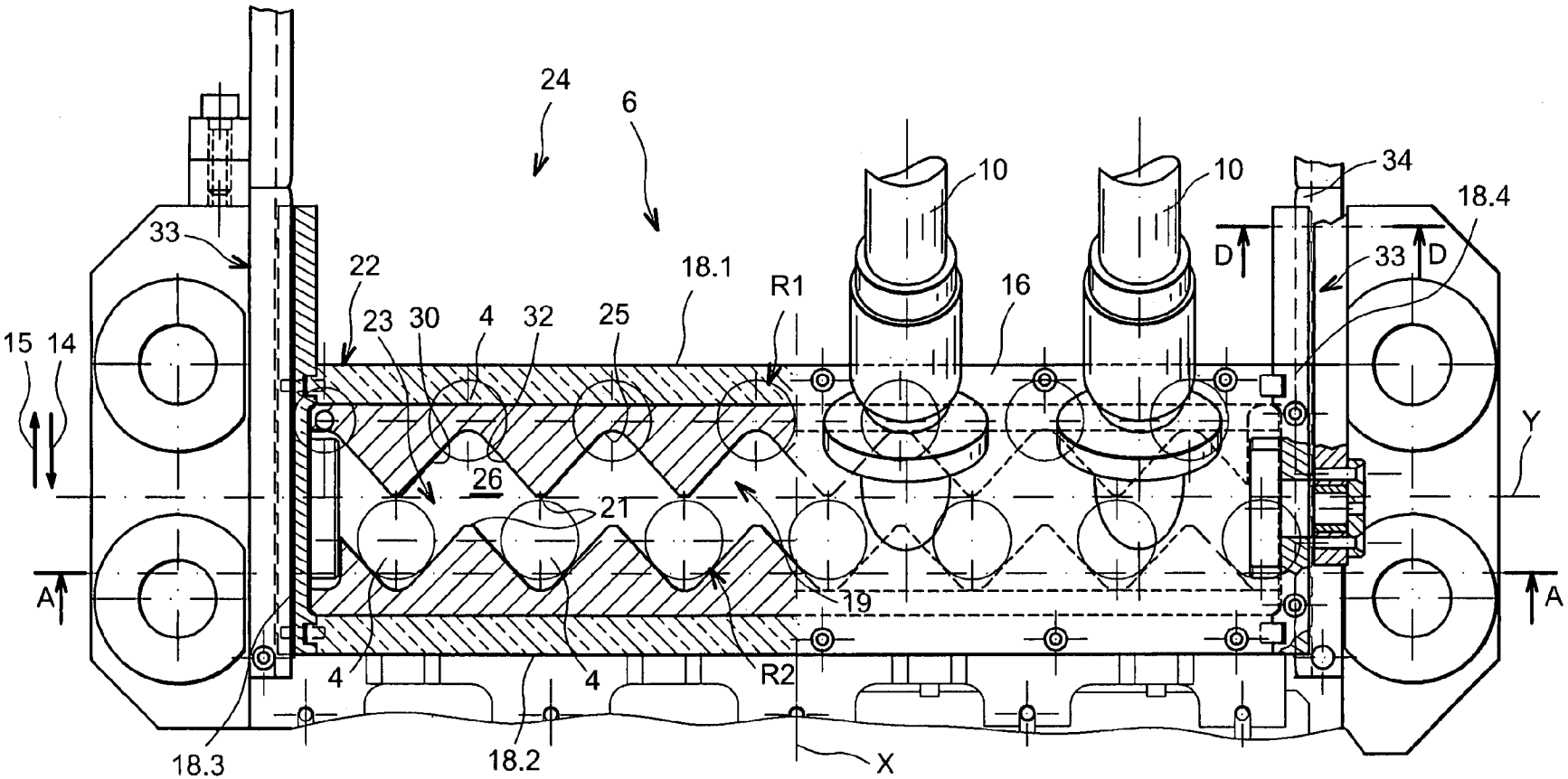
FIG. 2 is a partial sectional view of a dispenser according to the present invention.
Figure 3:
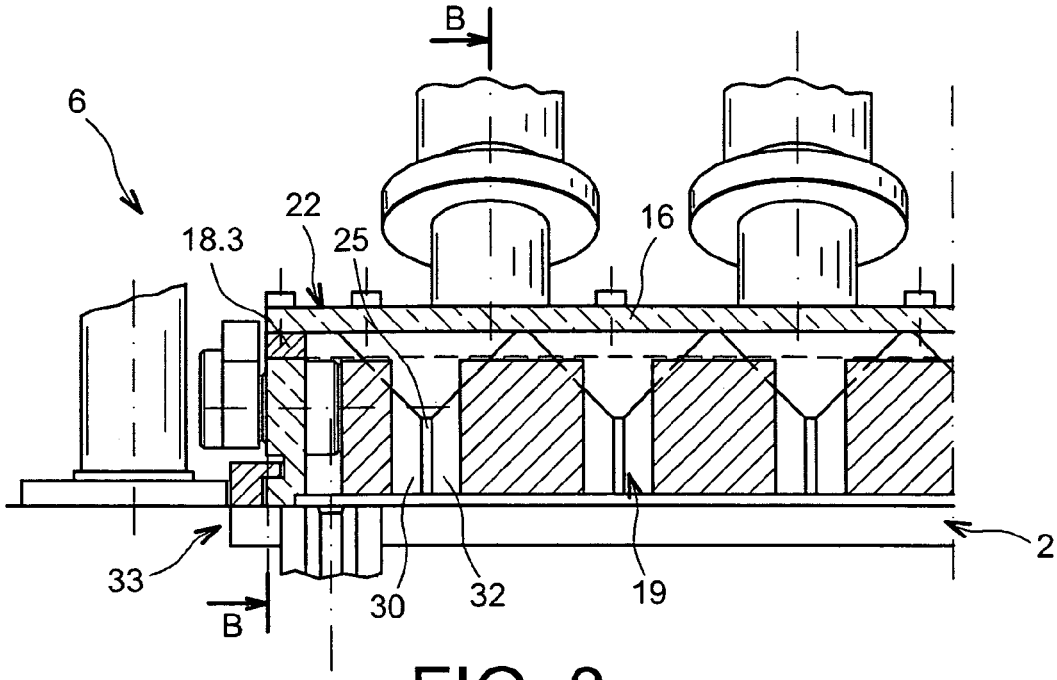
FIG. 3 is a sectional view along a vertical plane A-A of the dispenser of FIG. 2.

In FIG. 2, a detailed illustration may be seen of a shoe according to the present invention, including a casing 22 with a substantially rectangular shape, formed by the side walls 18 and the upper wall 16. The side walls include walls 18.1 and 18.2 perpendicular to the X axis, the wall 18.2, a so-called front wall, preceding the rear wall 18.1 in the direction indicated by the arrow 14. Walls 18.3, 18.4 parallel to the X direction, together connect the ends of the front and rear walls respectively.

The shoe 6 is capable of sliding on the table 2along the X axis, between an extreme retracted position in which the shoe does not cover the dies 4, and an extreme advanced position (position D), allowing evacuation of the pellets.

Table 2in the illustrated example includes fourteen dies or moulds positioned in first R1 and second R2 rows substantially parallel to the Y axis.

In the illustrated example, the rows are shifted relative to each other so that the dies are not aligned along axes parallel to the X or first displacement axis. Thus, when looking along the arrow 14, the orifices of the dies of the first row are between two orifices of dies of the second row except for the orifices on the extreme left of R1 and on the extreme right of R2 (FIG. 2).

More or less than fourteen dies and more than two rows may also be provided depending on the desired flow rates and pellet sizes.

According to the present invention, the shoe 6 includes inner plates 19, 23 provided with means for grouping the powder along distinct paths, so as to displace and impulse the powder towards each die by means of a significant shoe surface. With this, the adhesion of the powder and its adherence to the walls may be reduced. These means are formed by cavities delimited by surfaces 30, 32 tilted relative to the X or first displacement axis.

In the illustrated example the internal plates are of substantially identical geometry, we shall describe the wall 19.

The plate 19 has a sawtooth section along a plane parallel to the plane of the table 2, the teeth including tips 21 connected by bottom parts 25.

The end of the sawteeth may be more or less rounded.

The plate 19 is positioned relative to the table so that the dies are aligned with the bottom parts 25 between the teeth when looking along the arrow 14.

The bottom parts 25 are advantageously delimited by an arc of circle, avoiding retention of powder.

Advantageously, the plate 23 has the same dimensions as the plate 19.

The plate 23 is facing the plate 19. Advantageously, the teeth of the plate 23 are shifted along the Y axis relative to the teeth of the plate 19. Advantageously, the shift is a tooth half-width.

In the illustrated example, the profile of the plate 19 and of the plate 23 are complementary.

Advantageously, the plates 19, 23 are removable and fixed inside the casing. Thus, their replacement does not require replacement of the entire shoe. For this purpose, the upper wall of the casing is also removable.

It may also be provided that the grouping means 19, 23 be directly formed in the inner faces of the side walls of the casing.

The casing is for example made of CuZn and the grouping means for example of polymer.

The feed tubes 10 open out into the upper wall of the casing substantially between the contours of the plates 19, 23. In the illustrated example, the shoe is fed by four feed tubes 10 regularly distributed along an axis Y perpendicular to the X axis.

Provision may be made for more or less feed tubes. For example, six tubes may be provided opening out at right angles to the six bottom parts 25 of the wall 19 or 23, or else twelve tubes opening out at right angles to each bottom part 25.

In the illustrated example, four separate flexible pipes are used. But provision may be made for using a single feed tube 10 of an elongated shape and extending along the Y axis all along the upper surface of the casing thereby allowing a continuous feed all along the path delimited by the sawteeth.

The device according to the present invention also includes longitudinal guide means 33 allowing an accurate displacement of the shoe along the direction X relative to the table 2. The means 33 include an axial protrusion 34 borne by the shoe cooperating with a longitudinal groove 36 borne by the table 2, and visible in FIG. 5.

Figure 5:
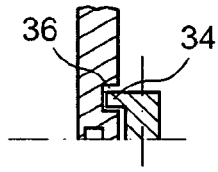
FIG. 5 is a sectional view of a detail of FIG. 2 along a plane D-D.
Figure 4:
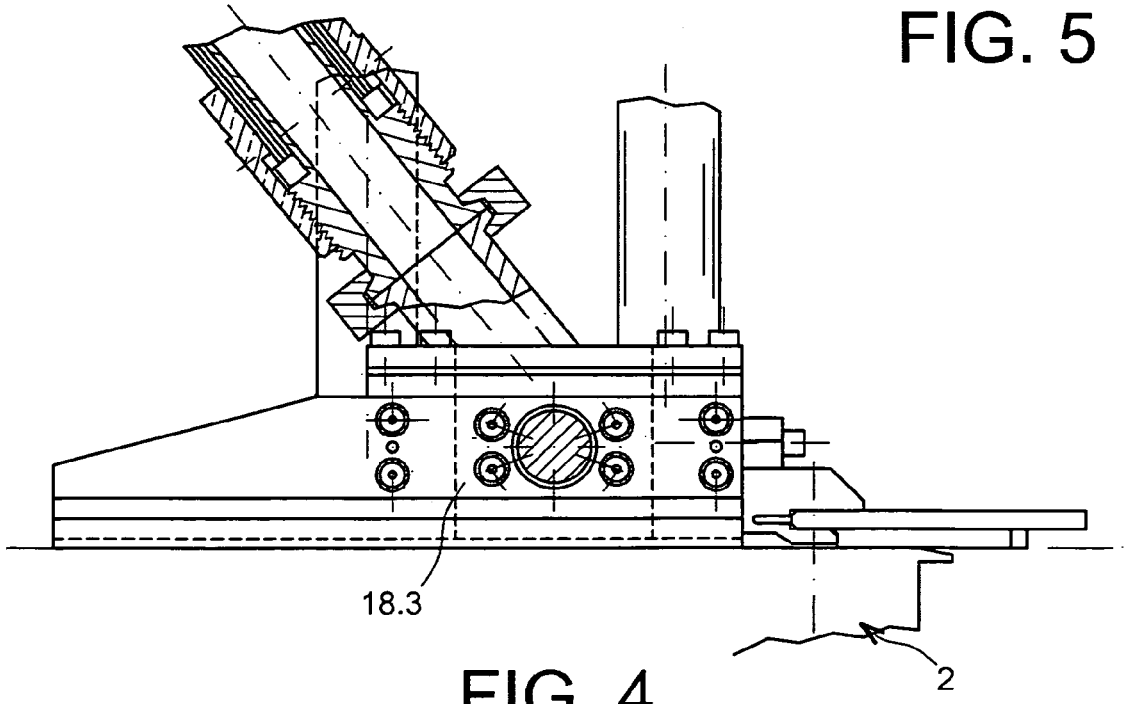
FIG. 4 is a partial sectional view along a vertical plane B-B of FIG. 3.

In FIG. 5, the detail of the axial protrusion 34 and of the groove 36 may be seen. Advantageously, the axial protrusion 34 is directed towards the casing and penetrates into the groove 36 or rail interposed between this protrusion 34 and a wall 18.3,18.4 of the casing. For mounting the shoe on the table, provision is made for at least one of the axial protrusions 34 attached on either side on the side walls 18.3,18.4 of the casing being removable, as this may be seen in FIG. 2.

It may be provided that the groove 36 be borne by the shoe and the protrusion 34 be borne by the table.

The shoe is maintained in contact with the table, and in particular with the dies, advantageously by mechanical means such as a spring. But the use of pneumatic means, for example a pneumatic actuator, may be provided.

Also advantageously, the hopper is for example fed by a suction system with a vacuum pump, or a mechanical one of the vibrating chute and worm screw type.

By using a shoe according to the present invention, it is possible to limit retention of the powder inside the shoe and the risks of packing the powder. Effective filling of the first and second rows is then obtained with increased flow rates.

Figure 6:
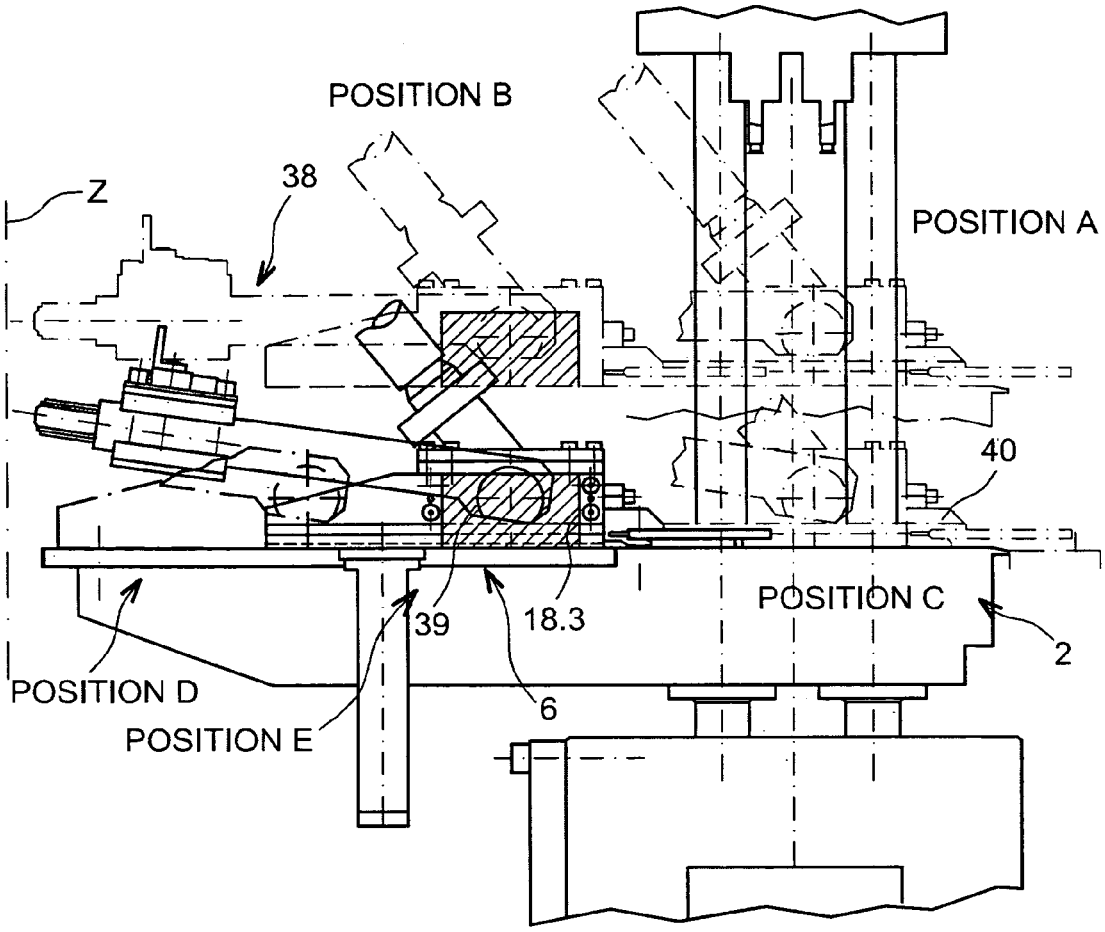
FIG. 6 illustrates the different positions of the dispenser during the making of pellets.

The shoe, during the filling, is displaced according to a reciprocal movement, along the arrows 14 and 15 along the X axis. With reference to FIG. 6, this movement is for example obtained by means of two cylinders 38 each mounted through one end 39, rotatably on the side walls 18.3,18.4 of the casing of the shoe and also mounted so as to be rotationally mobile through a second end opposite to the first end, on an actuating device (not shown).

Advantageously, the table is mounted so as to be mobile along a vertical axis Z, orthogonal to the X direction and to the Y direction. Because the actuator is rotatably mounted through both of these ends, both on the shoe and on the actuating device, the shoe entirely follows the displacement of the table.

The reciprocal movement of the shoe advantageously is of the sinusoidal or triangular type.

By using a displacement mode of the sine wave type, it is possible to attain a flow rate of the order of 9 grams of powder per second and by using a triangular law for the displacement of the shoe, flow rates of the order of 8 grams per second may be achieved.

The shoe also includes at a longitudinal end a nose 40 intended for pushing the pellets towards a conveyer after pressing (not shown).

According to a press model, a shaking axis and a shaking amplitude on either side of this axis are defined. The shaking axis corresponds to the central axis between the two rows of dies and the shaking amplitude ensures that the dies are covered by the powder from the shoe. By modulating the position of the shaking axis, i.e. by making its position asymmetrical relative to both rows of dies, it is possible to adjust a possible filling asymmetry between the front row and the rear row.

We shall detail the filling of the dies of the first row R1, the filling of the dies of the second row R2 being carried out in a symmetrical way.

When the means 19 move in the direction 15, the sawtooth profile of the grouping means 19 gathers the powder between each pair of teeth, the powder is displaced along the teeth towards the bottom parts 25. As the bottom parts 25 are aligned with the dies 4 of the first row R1 and positioned at the rear of the first row R1 before the filling, the latter encounter the dies 4 of the row R1, the powder gathered in the bottoms 25 at a certain instant, is at right angles to the dies 4 of the row R1 and falls into the latter. The filling of the dies is accomplished all the better since the powder is considerably impulsed by the means 19 providing a large surface for displacing the powder.

The same phenomenon occurs for the second row R2, when the means 23 moves in the direction 15.

All the powder required for making a pellet does not fall in one go into each die, but the filling is carried out over several passages by the reciprocal displacement of the shoe. Good filling homogeneity may be obtained by this filling in several steps.

Further, the conjugate reciprocal movement of the shoe and the upward movement of the table create a phenomenon of suction of the powder towards the inside of the dies. As the lower punch is fixed, an upward movement of the table generates an increase in the free volume of the dies causing suction of the powder.

Figure 7:
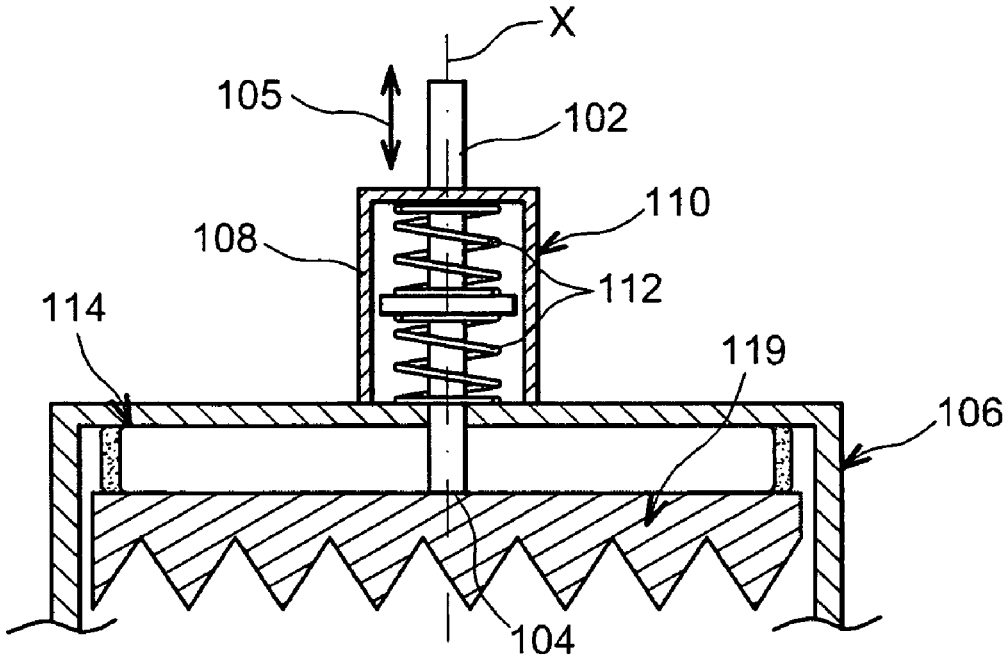
Figure 8:
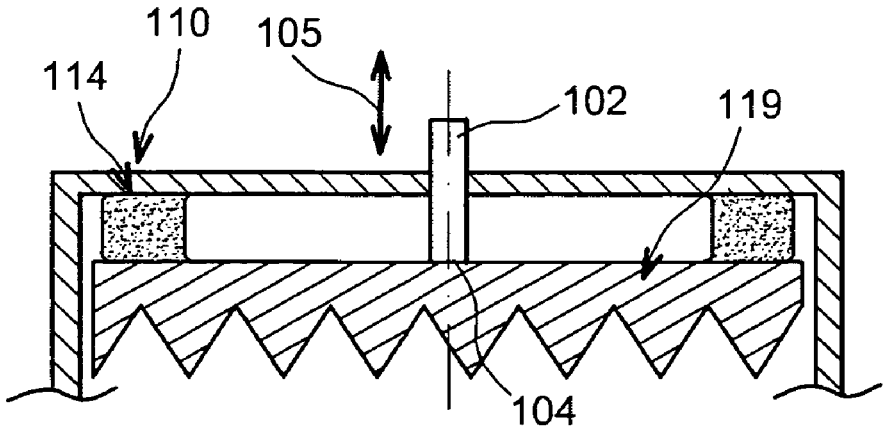

In FIGS. 7-9, an alternative embodiment of a dispenser according to the present invention may be seen, including a shoe 106 which differs from the shoe 6 of FIGS. 2-6, in that the grouping means are mobile relative to the casing.

The dispenser according to FIG. 7 includes a plate 119 bearing grouping means according to the present invention, the plate 119 being attached to a first end 104 of an arm 102 capable of being displaced along the X direction in a reciprocal movement along the arrow 105.

The arm is attached through a second end to an actuating device (not shown) capable of applying low amplitude displacements to the arm so as to set the grouping means 119 into vibration along the X direction.

Under the action of the arm, the grouping means move along the X direction inside the casing.

The dispenser also includes suspension means 110, in the illustrated example, formed by two helical springs 112 in series, reactively mounted between the arm 102 and a cage 108 fixed relative to the casing.

With the suspension means, the powder may be caused to vibrate at low frequencies and with a high amplitude, which causes a homogenous distribution of the powder over the whole surface of the shoe. These movements may be combined or linked with vibrations of lower amplitude and/or with a lower frequency, aiming at breaking the cohesion of the powder, in order to fluidify it and fill the dies properly.

The dispenser also includes a sealing means 114 between the casing and the grouping means in order to prevent the powder from being placed between the walls of the casing and the grouping plates. These sealing means in the illustrated example include an elastomeric ring, substantially coaxial with the arm 102.

In the illustrated example in FIG. 8, the ring 114 forms both sealing means and suspension means 110, the dimensions of the ring being determined in order to fulfil both of these functions.

Advantageously, the elastomeric material used withstands temperatures substantially comprised between 50° C. and 130° C. and radiations.

The ring is for example made by cutting it out in an elastomeric plate.

The ring is attached to the casing and to the grouping means, for example, by adhesive bonding or by vulcanization.

The ring may also be force-fitted onto protruding parts of the casing and of the grouping means, for example rings with an outer diameter larger than the inner diameter of the elastomeric ring.

Figure 9A:
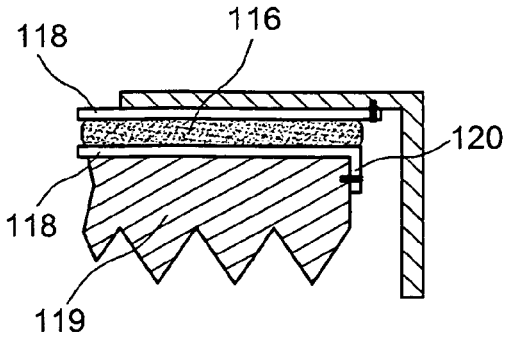
FIGS. 7, 8, 9A and 9B are schematic illustrations of alternative embodiments of a dispenser according to the present invention.
Figure 9B:
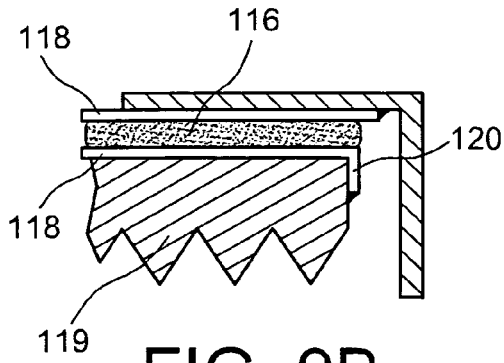

Making the suspension means in the shape of a cut-out ring in a sandwich material plate including an elastomeric layer 116 hemmed in between two metal sheet plates 118 may be also be contemplated (FIGS. 9A and 9B).

The metal sheets of the suspension means may be welded (FIG. 9B) and/or riveted (FIG. 9A) on the casing and the plates 119.

Only a plate provided with grouping means is illustrated in FIGS. 7, 8, 9A and 9B, but a device provided with two vibrating plates facing each other like in the dispenser of FIG. 2, does not depart from the scope of the present invention.

An excitator may be provided for each plate or a single excitator for both plates, the plates being for example rigidly connected.

Advantageously (cf. FIGS. 9A and 9B), the metal sheet in contact with the grouping means includes ends 120 folded back at right angles in order to follow the side contours of the grouping means, and an elastomeric layer overlapping from the rear face of the grouping means. In this way, the suspension means 110 also prevent any intrusion of powder between the grouping means and the casing.

In one embodiment, shaking of the powder is only caused by the vibration of the grouping means, the shoe no longer performing a reciprocal movement for shaking the powder.

On the one hand, the stresses on the arms provided with cylinders described earlier may be thereby reduced, the latter then being only used for large amplitude displacements for placing the shoe in the positions A to D illustrated in FIG. 6, for example allowing the shoe to be removed for the pressing.

On the other hand, there is also a reduction in the cycle time for making the pellets, since the powder is directly impulsed.

Further, as the shoe remains permanently above both rows of dies, the time for filling the dies is shorter than in the system where the shoe performs round trips between the upstream and downstream dies.

A dispenser which provides shaking of the powder both by a reciprocal movement of the shoe and by causing vibration of the grouping means does not depart from the scope of the present invention.

Advantageously, the excitator is provided outside the shoe, facilitating maintenance. Further, with this external arrangement, risks of failure for lack of ventilation may be avoided.

The grouping means capable of vibrating, are preferably localized as near as possible to the dies in order to break cohesion of the powder where it should be evacuated.

The excitator for example includes an electromagnetic excitation device, for example a vibrator or it is of the piezoelectric excitator type.

The use of vibrators has the advantage of allowing wide frequency and amplitude ranges.

Any type of excitators, for example of the magnetic type, may be adequate.

The device for making pellets include, as described earlier, means for controlling the displacement of the shoe and also for controlling the excitator according to determined cycles so as to ensure repeatability of the filling of the dies. Strong amplitude vibrations may be provided at the beginning of the cycle and then vibrations of lower amplitude and/or vibrations of variable frequency.

A method for making pellets applying the dispenser according to the present invention will now be described in relationship with the positions A to E of the shoe illustrated in FIG. 6.

According to the present invention, the making method includes the following steps:

a) placing the shoe on the dies (position A), the shoe including means for grouping the powder along distinct axes,
b) filling the matrices by shaking the grouping means,
c) removing the shoe (position B),
d) compressing the powder,
e) evacuating the pellets (position C).

During step b), the valve 20 is open allowing the powder contained in the hopper to flow into the casing of the shoe through the pipes 10.

Next, the casing of the shoe performs reciprocal movements (for example seven or eight round trips) and/or the grouping means are set into vibration providing uniform distribution of powder and preventing cohesion of the powder particles. During this filling, the lower punch may be moved so as to cause a suction effect.

During step c), the shoe has a displacement, rearwards on the table 2, of large amplitude, relative to the reciprocal movements during the shaking, so as to completely clear the dies for the approach of the upper punch.

During step d), the powder is pressed between the upper punch and the lower punch during a determined time. A change in the displacement velocity of the upper punch may be provided during the pressing.

During step e), the table moves downwards causing ejection of the pellets from the dies, and then the shoe performs a large amplitude movement forwards in order to push the pellets towards a conveyer positioned at the front end of the table.

The method may include an additional step for emptying the shoe, the latter is then placed in an emptying position (position D), above orifices connected to means for sucking up the powder remaining in the shoe.

Next at the end of the cycle, the shoe is placed in a waiting rest position (position E).

For positions C to E, the table is in the low position.

By means of the shoe according to the present invention, a gain of several seconds may be achieved on the time for filling the dies.

The invention claimed is:

1. A device for making pellets including a table provided with a plurality of pressing dies, substantially with the dimensions of the pellets to be made, the dies being positioned according to at least one row upper and lower punches intended to press the powder in the dies, a powder dispenser including a casing provided on an upper wall of a connector to at least one powder feed pipe connected to a hopper, a conveyor for conveying powder into the dispenser, a device for displacing the dispenser on the table according to a reciprocal movement along a first displacement direction, said dispenser being suitable to impulse the powder in a reciprocal movement on a plane of the table along the determined displacement direction, and means for grouping the powder along distinct axes substantially parallel to the displacement direction, in order to simultaneously fill the plurality of pressing dies, each die being positioned on a grouping axis, the grouping means being borne by walls of the casing perpendicular to the displacement direction, the grouping means having a sawtooth section, the sawtooth section being considered along a plane parallel to the plane of the table, the distance separating the dies being equal to the distance separating the bottom parts of the teeth, the dispenser being positioned on the table so that during its displacement, each bottom part between two teeth covers a die of the table.

2. The device according to claim 1, wherein the row of dies is perpendicular to the displacement direction.

3. The device for making pellets according to claim 1, including downstream grouping means and upstream grouping means along the first displacement direction.

4. The device for making pellets according to claim 3, wherein the downstream grouping means are shifted transversely relative to the upstream grouping means by a tooth half-width, so that a tooth tip is facing a bottom part between two consecutive teeth.

5. The device for making pellets according to claim 1, wherein the dispenser includes a longitudinal guide cooperating with a guide means borne by the table.

6. The device for making pellets according to claim 1, wherein the guide of the dispenser include an axial protrusion on each transverse side , sliding in an axial groove fixed relative to the table.

7. The device for making pellets according to claim 6, wherein the axial protrusion is directed towards the casing and wherein at least one of the protrusions is removable.

8. The device for making pellets according to claim 1, wherein the dispenser is connected to a displacement device via two rotationally fixed arms through a first end on each of the faces of the casing, parallel to the displacement direction, respectively, and rotationally mobile through a second end opposite to the first end, said arms each including a cylinder.

9. The device for making pellets according to claim 1, wherein the grouping means are respectively borne by a mobile plate relative to the casing.

10. A device for making pellets including a table provided with a plurality of pressing dies, substantially with the dimensions of the pellets to be made, the dies being positioned according to at least one row, upper and lower punches intended to press the powder in the dies, a powder dispenser including a casing provided on an upper wall of a connector to at least one powder feed pipe connected to a hopper, a conveyor for conveying powder into the dispenser, a device for displacing the dispenser on the table according to a reciprocal movement along a first displacement direction, said dispenser being suitable to impulse the powder in a reciprocal movement on a plane of the table along the determined displacement direction, and means for grouping the powder along distinct axes substantially parallel to the displacement direction, in order to simultaneously fill the plurality of pressing dies with pellets, each die being positioned on a grouping axis, the grouping means being borne by walls of the casing perpendicular to the displacement direction, the grouping means having a sawtooth section, the sawtooth section being considered along a plane parallel to the plane of the table, the distance separating the dies being equal to the distance separating the bottom parts of the teeth, the grouping means being borne by a mobile plate relative to the table, the dispenser being positioned on the table so that during its displacement, each bottom part between two teeth covers a die of the table, said dispenser also including an excitation device capable of causing said plate to vibrate relative to the dies along the displacement direction.

11. The device for making pellets according to claim 10, wherein the excitation device includes an arm firmly attached through an end to the plate and through a second end to an actuator for actuating a reciprocal movement along the displacement direction and suspension.

12. The device for making pellets according to claim 11, wherein the suspension includes at least one spring pressed between the arm and the casing.

13. The device for making pellets according to claim 11, wherein the dispenser includes a seal interposed between the plates and the wall of the casing facing each other.

14. The device for making pellets according to claim 13, wherein the seal is formed by an elastomeric ring with an axis substantially coinciding with that of the arm.

15. The device for making pellets according to claim 11, wherein the suspension is formed by an elastomeric ring interposed between the plate and the wall of the casing facing each other and also forming the seal.

16. The device for making pellets according to claim 15, wherein the ring is maintained between two metal sheet plates so as to form a sandwich plate.

17. The device for making pellets according to claim 16, wherein the metal sheet in contact with the plate is welded and/or riveted on the latter.

18. The making device according to claim 10, wherein the excitation device is of the vibrator type or of the piezoelectric type.

19. The device for making pellets according to claim 1, wherein the dispenser includes a face forming a pusher having the shape of a nose sliding on the slide plane intended for pushing the pellets after they have been pressed.

20. The device for making pellets according to claim 1, including two parallel rows of dies, the dies of each row being equidistant from each other, and the dies of the first row being shifted relative to the dies of the second row by half of the distance separating the dies of the second row.

21. The device for making pellets according to claim 1, wherein the conveyor for conveying the powder includes at least one feed pipe connecting a powder supply hopper to said dispenser, said feed pipe extending in the direction of the rows of dies.

22. The device for making pellets according to claim 1, including a collector for collecting the contents of the dispenser after a cycle for filling the dies, said collector including at least one orifice provided in the table, connected through a pipe to suction means, the orifice being under the dispenser when the latter is in a particular emptying position, the collector transferring the collected powder into the hopper.

23. The device for making pellets according to claim 1, wherein the table is mobile along an axis perpendicular to its planar face.

24. A method for making pellets, with a device for making pellets including a table provided with a plurality of pressing dies, substantially with the dimensions of the pellets to be made, the dies being positioned according to at least one row, upper and lower punches intended to press the powder in the dies, a powder dispenser including a casing provided on an upper wall of a connector to at least one powder feed pipe connected to a hopper, a conveyor for conveying powder into the dispenser, a device for displacing the dispenser on the table according to a reciprocal movement along a first displacement direction, said dispenser being suitable to impulse the powder in a reciprocal movement on a plane of the table along the determined displacement direction, and means for grouping the powder along distinct axes substantially parallel to the displacement direction, in order to simultaneously fill the plurality of pressing dies with pellets, each die being positioned on a grouping axis, the grouping means being borne by walls of the casing perpendicular to the displacement direction, the grouping means having a sawtooth section considered along a plane parallel to the plane of the table, the distance separating the dies being equal to the distance separating the bottom parts of the teeth, the dispenser being positioned on the table so that during its displacement, each bottom part between two teeth covers a die of the table, said method including the steps:

filling dies with powder by means of the powder dispenser provided with grouping means along distinct axial directions corresponding to the arrangement of the dies, pressing the powder in the dies, evacuating the pellets.

25. The method according to claim 24, wherein, during the filling step, the dispenser has a reciprocal movement according to a sinusoidal law.

26. The method according to claim 24, wherein, during the filling step, the dispenser has a reciprocal movement according to a triangular law.

27. The method according to claim 24, wherein, during the pressing, the upper punches are displaced according to several velocities.

28. The method according to claim 24, wherein the grouping means are set into vibration.

* * * * *